US005613300A

United States Patent [19]

Schmidt

[11] Patent Number: 5,613,300

[45] **Date of Patent: *Mar. 25, 1997**

[54] ERGONOMIC UTILITY KNIFE/BOX CUTTER AND METHOD OF MAKING

[75] Inventor: Gregory G. Schmidt, Newport Beach, Calif.

[73] Assignee: Pacific Handy Cutter, Costa Mesa, Calif.

[ * ] Notice: The term of this patent shall not extend beyond the expiration date of Pat. No. 5,386,632.

[21] Appl. No.: 573,512

[22] Filed: Dec. 15, 1995

Related U.S. Application Data

[63] Continuation of Ser. No. 301,660, Sep. 7, 1994, abandoned, which is a continuation of Ser. No. 3,504, Jan. 12, 1993, Pat. No. 5,386,632.

[51] Int. Cl.[6] ..... B26B 5/00

[52] U.S. Cl. ..... 30/2; 30/125; 30/162; 30/320; 30/335; 30/339

[58] Field of Search ..... 30/2, 125, 162, 30/320, 331, 335, 55, 340, 339

[56] References Cited

U.S. PATENT DOCUMENTS

| | | | |
|---|---|---|---|
| D. 319,378 | 8/1991 | Wilcox . | |
| 336,112 | 2/1886 | Holdsworth . | |
| 1,496,927 | 6/1924 | Evers . | |
| 1,906,573 | 5/1933 | Gits . | |
| 1,960,130 | 5/1934 | Trubel . | |
| 2,578,896 | 12/1951 | Moore . | |
| 2,737,069 | 3/1956 | Weindel, Jr. . | |
| 2,754,584 | 7/1956 | Ferguson . | |
| 2,840,903 | 7/1958 | Christensen . | |
| 2,951,482 | 9/1960 | Sullivan | 30/340 |
| 2,960,769 | 11/1960 | Matwijcow | 30/340 |
| 3,178,812 | 4/1965 | Lurie . | |
| 3,192,624 | 7/1965 | Gringer . | |
| 3,195,231 | 7/1965 | Lightburn . | |
| 3,525,152 | 8/1970 | Fattori et al. . | |
| 3,577,637 | 5/1971 | Braginetz | 30/162 |
| 3,621,570 | 11/1971 | Kolde et al. . | |
| 3,857,176 | 12/1974 | Quenot . | |
| 3,879,847 | 4/1975 | Roll . | |
| 3,906,624 | 9/1975 | Manning . | |
| 3,937,473 | 12/1975 | Braginetz . | |
| 4,005,525 | 2/1977 | Gringer . | |
| 4,167,810 | 9/1979 | Gilbert . | |
| 4,389,776 | 6/1983 | Okada . | |
| 4,570,342 | 2/1986 | Baum . | |
| 4,604,805 | 8/1986 | Krieger . | |
| 4,678,996 | 6/1987 | DuBuque . | |
| 4,744,146 | 5/1988 | Schmidt . | |
| 4,761,882 | 8/1988 | Silverstein . | |
| 4,825,552 | 5/1989 | Bendickson et al. | 30/340 |
| 4,939,839 | 7/1990 | Gorst . | |
| 5,022,156 | 6/1991 | Kallens et al. . | |
| 5,054,198 | 10/1991 | Gmoch . | |

FOREIGN PATENT DOCUMENTS

| | | | |
|---|---|---|---|
| 531248 | 8/1931 | Germany | 69/21 |

*Primary Examiner*—Kenneth E. Peterson
*Attorney, Agent, or Firm*—Poms, Smith, Lande & Rose Professional Corporation

[57] ABSTRACT

A utility knife/box cutter includes an ergonomically-shaped handle portion with exterior stippling to provide a good grasp upon the knife. Within the handle portion, a channel member is received in a forwardly extending cavity and movably receives a cutting blade carrier for longitudinal movement relative to the handle portion. A cutter blade carried in the blade carrier is moveable between a storage position entirely within the handle portion and successively further forward use and replacement positions. Also received into the handle portion is a spare blade holder member pivotal between a blade retaining position entirely within the handle portion and a blade releasing position in which a forward part of the spare blade holder member is pivoted out of the handle portion to present spare blades for removal and transfer to the cutting blade carrier.

4 Claims, 3 Drawing Sheets

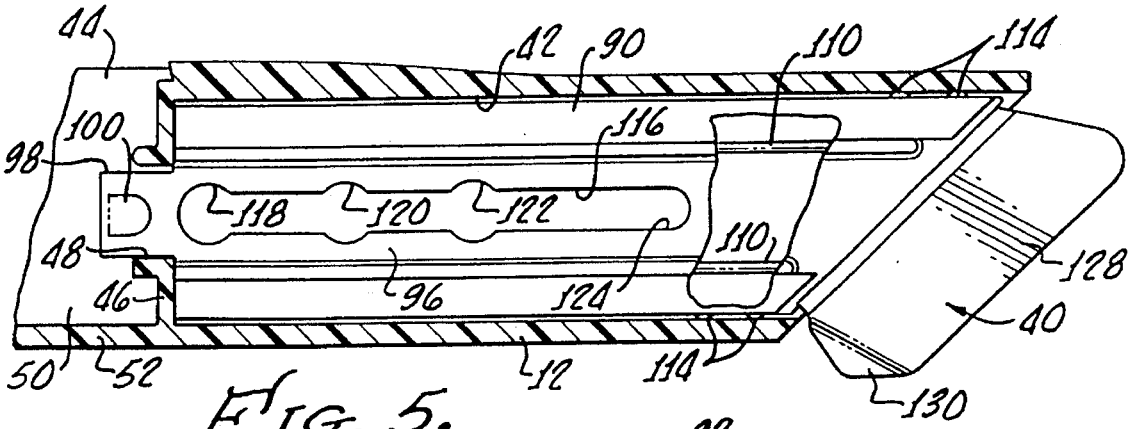
FIG. 5.
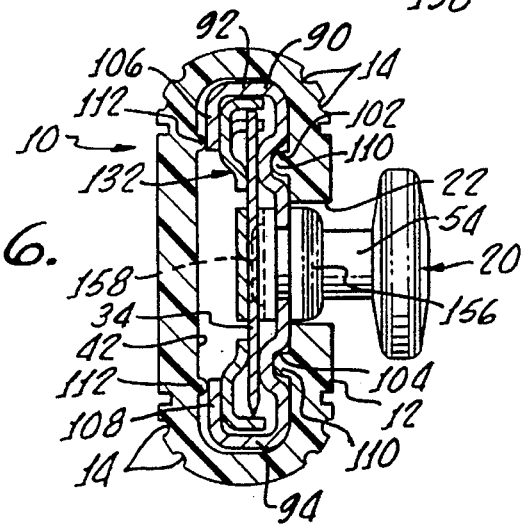
FIG. 6.
FIG. 7.
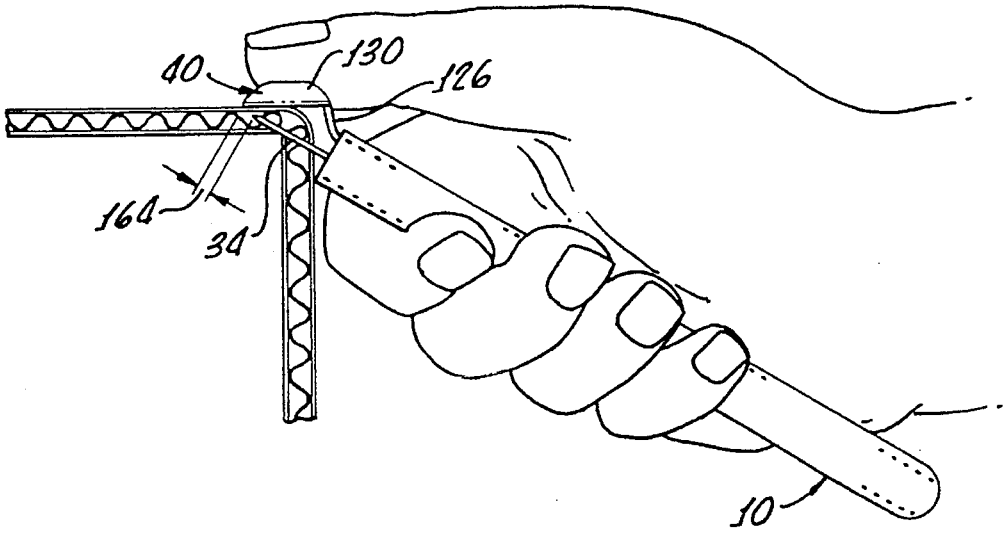

ERGONOMIC UTILITY KNIFE/BOX CUTTER AND METHOD OF MAKING

This application is a continuation of application Ser. No. 08/301,660, filed Sep. 7, 1994, now abandoned, which is itself a continuation of application Ser. No. 08/003,504 filed Jan. 12, 1993, now U.S. Pat. No. 5,386,632.

BACKGROUND OF THE INVENTION

1. Field of the Invention

The present invention relates to utility knives, and methods of making such knives. More particularly, the present invention relates to utility knives which are particularly adapted for use in cutting open corrugated cardboard shipping boxes, and include also a cutting guide serving to guard the exposed end of the cutting blade in such use. Still more particularly, the present invention relates to such utility knives which include a somewhat bulbular or ergonomically-shaped handle or body, a cutting blade movable in the body to extend a cutting portion of the blade outwardly of the body at one end of the latter, externally accessible means for moving the cutting blade between the extended cutting position and a retracted position of withdrawal into the handle, and provision for storage of several spare blades within the handle.

2. Related Technology

The field of utility knives includes many examples of previous attempts extending over many years all directed to providing a utility knife which satisfies one or more of the many concerns for such knives. Among the concerns addressed are making a utility knife which is inexpensive, safe in a variety of uses, rugged, reduces or prevents damage to the contents of cardboard boxes opened with the knife, is durable, easy to use, is easily grasped and provides good purchase on the knife for security and certainty in its use even while the user's hands may be moist and slippery, reduces the fatigue inherent in some of the strenuous uses of hard cutting for which such knives are used, provides conveniences in the use and maintenance of the knife, is attractive, and provides for the storage of spare knife blades within the utility knife itself.

For example, U.S. Pat. No. 3,192,624, issued in 1965 to D. Gringer, is believed to teach a utility knife in which a handle provides a forward longitudinal cavity in which is slidably received a blade carrier member, and a rear cavity in which are received a number of spare blades. The blade carrier member carries a double-ended cutting blade, and is movable longitudinally of the forward cavity between a retracted safety position with the blade entirely within the handle, and an extended cutting position in which a triangular end part of the blade extends forwardly out of the handle. The handle is vertically split and includes two portions which are almost mirror images of one another. A screw secures the two handle portions together and allows their separation with the use of a screwdriver for substituting one of the spare blades for a used cutting blade. A similar utility knife is presented in U.S. Pat. No. 3,879,847, issued in 1975 to D. Roll in which blades may be changed without disassembly of the handle by forward extension therefrom of a forward part of a channel-like blade carrier member. As Roll points out, his utility knife no longer requires the inconvenience of carrying a screwdriver with which to open the handle of prior utility knives. However, his knife also appears not to offer the convenience of spare blade storage in the knife handle.

An alternative type of utility knife is represented by the 1931 German Patent No. 531,248, and descendants of the disclosed design. This design of utility knife includes a flattened tubular handle, with a blade carrier slidable in the handle between a retracted position sheathing the blade entirely in the handle, and an extended cutting position in which part of the blade is exposed forwardly of the handle. A spring-arm part of the blade carrier includes a lug receivable in detent notches of the handle to retain the carrier in selected positions, including the retracted position and various positions of blade extension. A button member is secured to the spring arm for disengaging the lug from the detent notches and moving the blade carrier to a selected position. Some members of this design family include differing handle designs, differing means of securing the blade carrier in position, and use differing types of blades. For example, the common single-edge razor blade is a favored blade for many of these utility knives although it has many deficiencies in such use. That is, the razor blade is brittle, thin, and not very rugged. Consequently, a razor blade may break off if, for example, a twisting or bending moment is imposed on the blade in use. Certain other of these knives use a trapezoidal-shaped double ended all-purpose (AP) blade, which is considerably more rugged than a razor blade.

U.S. Pat. Nos. 2,840,903; 3,195,231; 3,525,152; 3,621,570; and 4,570,342, may be considered as representative design descendants of the 1931 German patent discussed above. Generally, this type of knife is made with a handle of folded sheet metal, having a rather small edge radius opposite to the blade edge and against which cutting pressure may be exerted by the user. All of these knives are relatively thin, and provide only a small handle edge surface area against which manual cutting pressure may be exerted. This small handle edge radius and small edge surface area can combine to make many of these knives uncomfortable to use, especially in hard cutting use. Even when the user is wearing gloves, some of these knives are so thin that an uncomfortable pressure groove is soon formed in the user's hand after a period of hard cutting. Users then find themselves shifting the knife in their hand to avoid the sensitive pressure groove, and in the process attempting to use the knife in a less than optimum grasp. Understandably, this type of use contributes to fatigue and injuries. While some of these knives provide a handle with somewhat increased manual surface area, all are deficient to some degree with respect to the grasp or purchase on the knife afforded to a user. Especially in hard use, the thin, fragile, or difficult to control knives of the above category are not well accepted by users.

A further branch of design in the utility knife area is represented by those utility knives adapted more especially for their use in opening cardboard cartons or boxes. In this use, the carton is generally held in front of the user with one hand and arm, and is cut by drawing the knife with the other hand toward the user across the side wall of the carton. Because such use frequently involves the need for speedy work, and the cardboard does present considerable resistance to cutting, flesh wounds are common when the knife blade springs free at the end of a cut and catches the user's arm. In this use particular attention must be given to protecting both a user of the knife, and the contents of a cardboard carton to be opened with the knife, from being inadvertently cut. For this use, U.S. Pat. No. 3,178,812, issued in 1962 to A. J. Lurie, depicts a utility knife having a pair of spaced apart plate-like blade guards, one for within and the other for outside of a carton. The inner guard is to protect the carton contents during cutting of the carton sidewall, and is carried at the end of a hook-like extension of the handle. This type of utility knife would seem to present inconveniences in use because of the necessity to provide for entry into the carton of the inner plate-like guard. A similar hook-like guard is seen in U.S. Pat. No. 4,167,810, issued in 1979 to R. Gilbert. The Gilbert teaching includes a formed wire hook-like inner guard for protecting the contents of a carton from the blade while the carton is opened. A hard point is provided for punching a hole in the carton for subsequent insertion of the formed wire hook.

An alternative form of blade guard, this one for protecting the knife user, is seen in U.S. Pat. No. 4,675,996, issued in 1987 to T. DuBuque. The Dubuque knife includes a pair of spring-loaded pivotal guard plates secured to the handle of the knife in such a way that they are asserted to prevent accidental exposure of the blade edge. The guards are stated to pivot and expose the blade edge when the knife is drawn along the side of a carton. The guards are said to roll on the cardboard surface. Why these pivotal guard plates would not also pivot away to expose the blade if the knife were inadvertently drawn across the user's arm, for example, is not clear from the patent.

An alternative form of blade guard for protecting both user and carton contents is depicted in U.S. Pat. No. 4,744,146, issued in 1988 to G. G. Schmidt, and owned by the assignee of the present application. In the Schmidt knife a planar plate-like guard member lies adjacent to, but spaced from, the blade in its extended carton-opening position. The plate-like guard member provides a guide surface by which the knife may be guided along the top corner of a carton to be opened while the carton side wall is cut to remove the carton top. Because the edge of the blade is recessed behind the edges of the guard plate, a user of the knife is not likely to be cut with the knife. Also, because the blade penetrates the side wall of the carton a controlled amount immediately adjacent to the top inside wall of the carton, the contents are not likely to be injured by the blade. The Schmidt knife also offers a considerably improved ease of use because its handle is formed of a sturdy aluminum extrusion offering a considerably larger surface area against which cutting pressure can be applied by a user of the knife, as well as more comfortable rounded outer edge surfaces of larger radius than some other knives. This knife also includes features avoiding accidental dropping of the worn blade when replacing the blade is necessary, and provides for storage of several spare blades within the knife.

A similar guard member is seen in U.S. Pat. No. 5,054,198, issued in 1991 to R. Gmoch, differing so far as the guard feature is concerned only in the angular relation of the guard to the length of the cutting blade.

SUMMARY OF THE INVENTION

In view of the above, the present invention provides a utility knife with an ergonomically-shaped handle portion at a forward end defining a longitudinal cavity, a channel member received in the cavity, a blade carrier member received in the channel member for receiving a cutting blade, a lock to retain the blade carrier in a selected position relative the handle portion, and an aft recess receiving spare cutting blades.

Further, the present invention provides a utility knife as described above also including the channel member defining a pair of longitudinal grooves and a pair of longitudinal edge surfaces, the handle portion having plural longitudinal ribs respectively engaging said grooves and edge surfaces to support the channel member in opposition to cutting forces.

The present invention further provides a utility knife/carton cutter with a bulbular ergonomic handle portion having an exterior surface which provides considerable area for application of manual cutting force to the knife, and which is stippled or textured in selected surface portions thereof to provide a user of the knife with a slip-resistant grasp thereon. The handle portion defines a forwardly-extending elongate longitudinal cavity separated by a perforate partition wall from a rearward upwardly-opening recess. In the rear recess, a spare blade holder member is pivotally received and movable between a closed blade-retaining position, and an open blade-releasing position in which a forward portion of the spare blade holder member is pivoted upwardly out of the recess and free of the remainder of the handle portion. In the forward elongate longitudinal cavity, a channel member is received. The channel member includes a tab extending through a perforation of the partition wall into the rearward recess, there to be permanently retained against the opposite side of the partition wall to capture the channel member in the forward cavity. The channel member defines a pair of longitudinal grooves and a pair of longitudinal edge surfaces, each of which are engaged by a respective longitudinal rib within the forward cavity to support the channel member in opposition to cutting forces on the knife. Within the channel member, a blade carrier member is slidably received. The blade carrier member is itself channel shaped to receive therein an all purpose (AP) blade. Further, the blade carrier is somewhat tray-shaped to prevent accidental dropping of an old blade when the blade carrier is moved outwardly of the channel member to a blade changing position. This tray shape of the blade carrier also eases insertion of the replacement blade into the carrier. The blade carrier includes an integral spring arm portion distally carrying a button member outwardly extending through congruent longitudinal slots of the channel member and handle portion. An enlarged inner collar portion of the button member is receivable into semicircular enlargements of the channel member slot to lock the blade carrier member in selected positions of its movement. An outer end portion of this button member is accessible to the user on the side of the knife for unlocking the blade holder and moving the blade to selected storage or use positions. The channel member also defines an integral plate-like guide and blade guard outwardly of the handle portion. This plate-like blade guard shields the blade in its carton-opening position and is angulated toward intersection with the blade to further reduce the possibility of accidental user contact with the blade. Also, the angulation of the guide/guard plate improves separation of the blade from contents of a carton in that position of the blade. The blade guide/guard does not intersect with the blade, however. Thus, when the blade is extended farther outwardly past the guide/guard plate, an end part of the blade is available for a variety of utility uses.

As may be appreciated from the above, the present invention provides a utility knife which offers unprecedented comfort and convenience in use. The ergonomic design of the handle portion provides a good grasp on the knife with plenty of surface area so that cutting forces do not cause discomfort from concentrated forces on a small area of the user's hand. The blade guide/guard provides both improved protection to the user and improved protection to the contents of a carton when the knife is put to such carton opening use. Spare blades are conveniently stored in the rear recess of the knife handle and are easily accessed without the need for a tool or any disassembly of the knife. When a blade change is needed, the tray-like design of the blade carrier presents the old blade for easy removal and disposal with little chance of a dropped blade. Also, insertion of the new blade into the knife is additionally eased because the user need only lay the new blade into the tray-like carrier, with engagement of the blade on a pair of location tangs, and withdraw the blade carrier into the handle to a use or storage position. Because the handle portion of the knife may be made of polymer material having a considerably lower coefficient of heat transfer than conventional knives with metal handles, the present knife is much warmer and more comfortable to use in cold environments, such as refrigerated food storage warehouses.

These and other advantages of the present invention will be apparent from a reading of the following detailed description of a single preferred embodiment of the invention, taken in conjunction with the following drawing figures.

BRIEF DESCRIPTION OF THE DRAWING FIGURES

FIG. 1 provides a side elevation view of a utility knife/box cutter according to the present invention;

FIG. 2 is a side elevation view of the utility knife/box cutter seen in FIG. 1, with a spare blade storage member pivoted upwardly out of a handle portion of the knife to a blade releasing position, and the cutting blade of the knife advanced out of the handle to one of two use positions therefor;

FIG. 3 provides an exploded perspective view of the utility knife/box cutter with the spare blade holder member and other component parts of the knife shown in positions to better illustrate their structure and cooperation in the knife;

FIG. 4 is an enlarged fragmentary cross section view generally at line 4—4 of FIG. 3, and with the spare blade holder member pivoted into its blade retaining position within the handle portion;

FIG. 5 provides an enlarged fragmentary cross sectional view similar to FIG. 4, but showing the utility knife from the opposite direction of view at the same 4—4 section line;

FIG. 6 is a cross sectional view taken at line 6—6 of FIG. 1, also shown enlarged to better depict details of the structure; and FIG. 7 is a fragmentary view showing the utility knife/box cutter of the present invention in use to cut open a corrugated box, and depicting additional salient features of the invention.

DESCRIPTION OF THE PREFERRED EMBODIMENT

Figure 1:
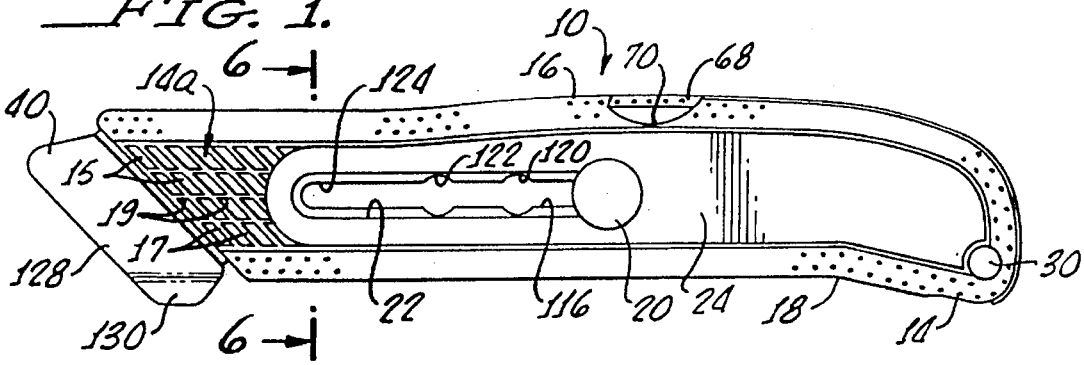

Viewing FIG. 1, a utility knife/box cutter 10 is shown in side elevation view. The depicted knife 10 is right-handed, a left-handed knife being the same in all respects while being a mirror image of the right-handed knife. The utility knife 10 includes a somewhat bulbular, elongate, and ergonomically-shaped handle portion, generally referenced with the numeral 12. Handle portion 12 includes a peripheral portion 14 which is textured or stippled to provide a good grip for a user of the knife 10. A side surface portion 14*a* of the handle portion 12 is also textured to provide secure engagement of the user's right thumb, recalling that the depicted knife 10 is right-handed. The surface portion 14*a* defines a plurality of shallow recesses 15, each shaped like a parallelogram, and cooperating to define plural longitudinal ribs 17 and angulated ribs 19. The ribs 17 and 19 are each disposed to provide purchase of a user's thumb on the surface 14*a* to resist the predominant cutting forces in the use of the knife 10. That is, the ribs 17 and 19 are disposed generally perpendicular to the primary (arrow 17*a*) and secondary (arrow 19*a*) cutting forces exerted by a user's thumb on the knife 10 during use thereof.

Further, the handle portion 12 includes both an upper outwardly convex curved handle surface portion 16, and a longitudinally spaced lower outwardly concave curved handle surface portion 18. The handle portion 12 is also somewhat thick and rounded (viewing FIG. 6) so that the curved surface portions 16,18 cooperate to provide a handle laying naturally in the palm of a user's hand, with convex surface 16 against the palm, and the fingers wrapped generally leftwardly of the concave curved surface 18.

FIG. 1 depicts the utility knife in a safe storage condition with a cutting blade (not seen in FIG. 1) withdrawn into the handle portion 12. As will be seen, an operating button 20 extends outwardly through a slot 22 on a side surface 24 of the handle 12, and is used to move the cutting blade from the storage position to one of two use positions, or to a blade changing position.

Figure 2:
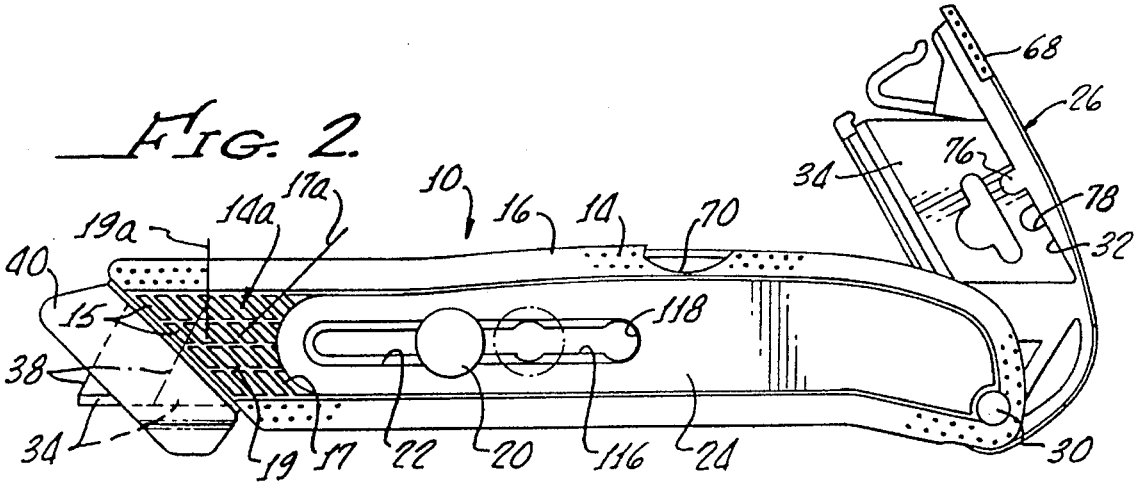
Figure 4:
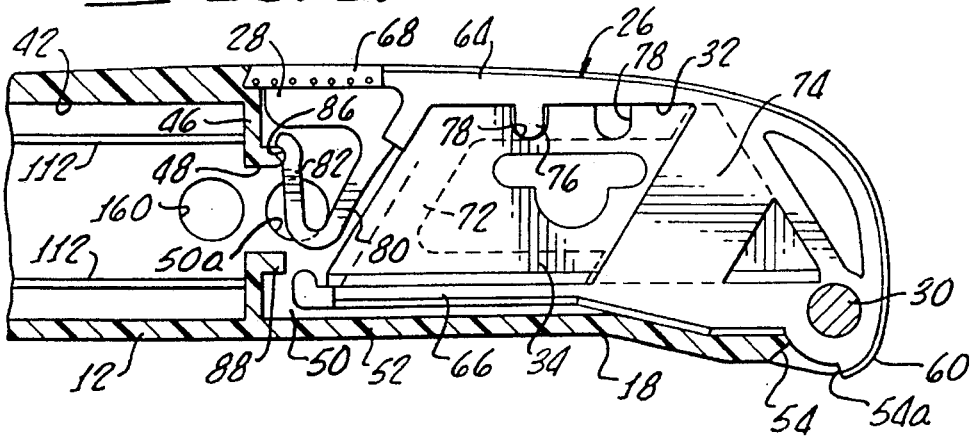

Turning now to FIG. 2, the utility knife 10 is shown with a spare blade storage member 26 pivoted upwardly at its forward end 28 out of the handle portion 12. The spare blade storage member 26 is pivoted in the handle portion 12 by a pivot pin 30. Within the spare blade storage member 26, a trapezoidal pocket 32 receives a plurality of trapezoidal all-purpose utility blades 34. As will be seen, the pocket 32 communicates with a slightly smaller window 36 (best seen in FIG. 3) opening away from the viewer of FIG. 2 so that spare blades cannot escape in that direction, but so that a finger may be used to bring the blades forward for removal and use of the nearest blade. At this point, it is well to note that the handle portion 12 and spare blade holder member 26 are both formed of a strong, shape-retaining, but somewhat yieldable, injection molded engineering thermoplastic. For example, the portion 12 and member 26 may be formed of a fibre reinforced polymer (FRP). A specific example of the type of material which may preferably be used to form the handle 12 and member 26 is a glass fibre reinforced Nylon 6 material, although there are other materials in the market such as ABS and Delrin which will also serve well in the present use.

FIG. 2 also shows the button member 20 advanced forwardly from the storage safe position of FIG. 1 to a first use position shown in dashed lines, and in which a forward portion 38 of a cutting blade advances outwardly of the handle portion 12 behind a plate-like blade guide/guard member 40, to the position shown entirely in dashed lines. Alternatively, the button member 20 may be advanced to a second use position shown in solid lines on FIG. 2, in which the cutting blade 34 extends beyond the guide/guard member 40 so that the portion 38 is partially exposed, as seen in solid lines on FIG. 2. Still alternatively, as will be explained, the button member 20 may be advanced forwardly still further in slot 22 to a blade changing position so that one of the spare blades 34 may be substituted for the cutting blade.

Considering now FIGS. 3–6 in conjunction, and recalling that structure already described by reference to FIGS. 1 and 2, it is seen that the handle portion 12 defines both an elongate forwardly extending cavity 42, and an upwardly and rearwardly opening rear recess 44. A partition wall 46 (best seen viewing FIGS. 4 and 5) separates the cavity 42 and recess 44, and defines an aperture 48 communicating therethrough. The recess 44 is cooperatively defined by a pair of spaced apart side walls 50, extending upwardly from a lower wall 52 (viewing FIGS. 3, 4, and 5). The lower wall 52 also defines a rear abutment surface 54 (seen in FIG. 4), the importance of which will be described below. Side walls 50 include arcuate end parts 56 and define a pair of aligned bores 58 (viewing FIG. 3). The spare blade holder member 26 at an arcuate end part 60 includes a bore 62 cooperable with the bores 58 to receive the headed pivot pin 30. After its receipt into the bores 58,62, the far end of pin 30 is swaged to permanently retain both the pin 30 in these bores, and the spare blade holder member 26 in the recess 44. The arcuate end parts 56 and 60 are disposed toward the lower side of the handle portion 12. That is, the end parts 56 and 60 are diposed toward the lower concave surface portion 18 and away from the upper convex surface portion 16 so as to assist in forming a somewhat angulated shape for the handle portion 12 in side view, recalling FIGS. 1 and 2. Thus, the combination of the rounded cross sectional shape, upper convex surface portion 16, lower concave surface portion 18, and the relative lowered position of the arcuate end parts 56,60 all cooperate and contribute to providing an overall ergonomic shape for the knife 10.

Viewing the spare blade holder member 26 in greater detail, it is seen to include an upper wall part 64 which completes the outer convex surface 16 when the spare blade holder member is pivoted inwardly of the recess 44, and a lower wall part 66. Both of the wall parts 64,66 bound the pocket 32. The upper wall part 64 includes a forward portion 68 which is accessible with a finger nail via a crescent-shaped groove 70 in the nearer of the two side walls 50, viewing FIG. 3, to pivot the spare blade holder member 26 out of the recess 44. Extending into the pocket 32, and cooperating to define the window 36, the spare blade holder member 26 includes a flange-like wall portion 72 spanning between the wall portions 64,66. At the front of pocket 32 and also spanning between the wall portions 64,66, the spare blade holder member 26 includes a trapezoidal shaped flange-like wall portion 74. Depending from the upper wall part 66 is a transverse rib 76 receivable into one of the upper notches 78 of the blades 34.

At its forward end 28, the spare blade holder 26 includes a depending J-shaped wall portion 80, which at its free end 82 is somewhat flexible. The free end 82 of wall portion 80 defines a forwardly opening transverse notch 84. Viewing FIG. 4, it is seen that the partition wall 46 includes a pair of transverse stiffening ribs 86,88 extending between the side walls 50, and respectively disposed immediately above and below the aperture 48. When the spare blade holder member 26 is pivoted into the recess 44, the notch 84 receives the upper one (86) of the ribs 86,88 to retain the holder member 26 in recess 44. Because the material from which the handle member 12 and spare blade holder member 26 is formed is somewhat yieldable, the spare blade holder 26 may be pivoted out of recess 44 with the force of a finger nail in groove 70 lifting wall portion 68. That is, the depending wall portion 80 will yield elastically to allow the spare blade holder member 26 to pivot out of recess 44. This outward pivotal movement brings an abutment 54*a* of the member 26 into engagement with the abutment 54 of the lower wall 52 to limit further outward pivotal movement of the spare blade holder member 26.

Also viewing FIGS. 3–7 in conjunction, it is seen that the cavity 42 of handle portion 12 receives an elongate metal channel member 90. In fact, the channel member 90 defines a pair of confronting channel portions 92,94 separated by a web portion 96. At its aft end, the channel member 90 includes a tang 98 extending from the web portion 96 through the aperture 48 into recess 44, and there being cut out in a generally C-shape to form a laterally displaced tab 100. The web portion 96 also defines a pair of longitudinal grooves 102,104, while the channel portions 92,94 at their free side opposite the web portion 96, define a pair of side surfaces 106,108.

Within the cavity 42, the handle portion 12 includes two pairs of longitudinal ribs 110,112. The ribs 110 are received into grooves 102,104, and the ribs 112 engage side surfaces 106,108, to securely position the channel member in the cavity 42. Additionally, the channel member 90 includes an upper pair and a lower pair of nubs 114 extending respectively upwardly and downwardly from the channel member adjacent the forward end thereof. When the channel member 90 is inserted into the cavity 42 during manufacture of the knife 10, its outer surfaces are snugly engaged by the somewhat yieldable material of the handle member. The ribs 110,112, engage grooves 102,104, and side surface 106,108, respectively, to further insure sturdy attachment of the channel member 90 into the handle portion 12, and to resist cutting forces. And further, the nubs 114 wedge into the cavity 42 to provide additional securement for the channel member 90. One of the side walls 50 defines a staking aperture 50*a* (best seen viewing FIG. 4) through which a staking tool may laterally enter recess 44 to laterally displace the tab 100. Once this staking operation has been performed, the channel member 90 is permanently captured in the cavity 42.

Channel member 90 also defines a longitudinal slot 116. This slot 116 includes a semi-circular enlargement 118 at the aft end thereof, and a pair of spaced apart semi-circular enlargements 120,122 spaced forwardly of the aft enlargement 118. Also, slot 116 includes a forwardly extending slot portion 124 forward of the enlargement 122. With the channel member 90 in the cavity 42, the slot 22 of handle 12 is congruent with slot 116. Forwardly of the handle portion 12, the channel member 90 integrally includes the plate-like blade guide/guard 40. In order to define the guide/guard 40, the channel member 90 includes a first inner and laterally angulated portion 126. Forwardly of the portion 126, the channel member 90 also includes a second outer and laterally angulated plate-like portion 128, which is larger than the portion 126, and is angulated laterally in the opposite direction. At its lower extent, the second portion 128 includes an outturned plate portion 130 serving like a ski tip to facilitate sliding of the guide/guard 40 over the outer surface of a carton, as will be seen.

Within the channel member 90 is slidably received a cutting blade carrier member 132, which itself is channel or tray-shaped. That is, the blade carrier member 132 includes a web portion 134, with an upper 136, and a lower 138, laterally extending wall part. The upper wall part 136 includes a pair of spaced apart notches 140 in which respective tangs 142 extend laterally to respectively engage the forward one of the notches 78 of the cutting blade 34, and to engage the aft end edge 34*a* of this cutting blade (viewing FIG. 3). At its forward end, the wall part 136 also includes an inturned tab 144 engageable with the forward end edge 34*b* of the cutting blade 34. Integrally formed as part of the web 134, the carrier member 132 includes a spring arm portion 146 which near its distal end 148 defines an aperture 150.

Figure 3:
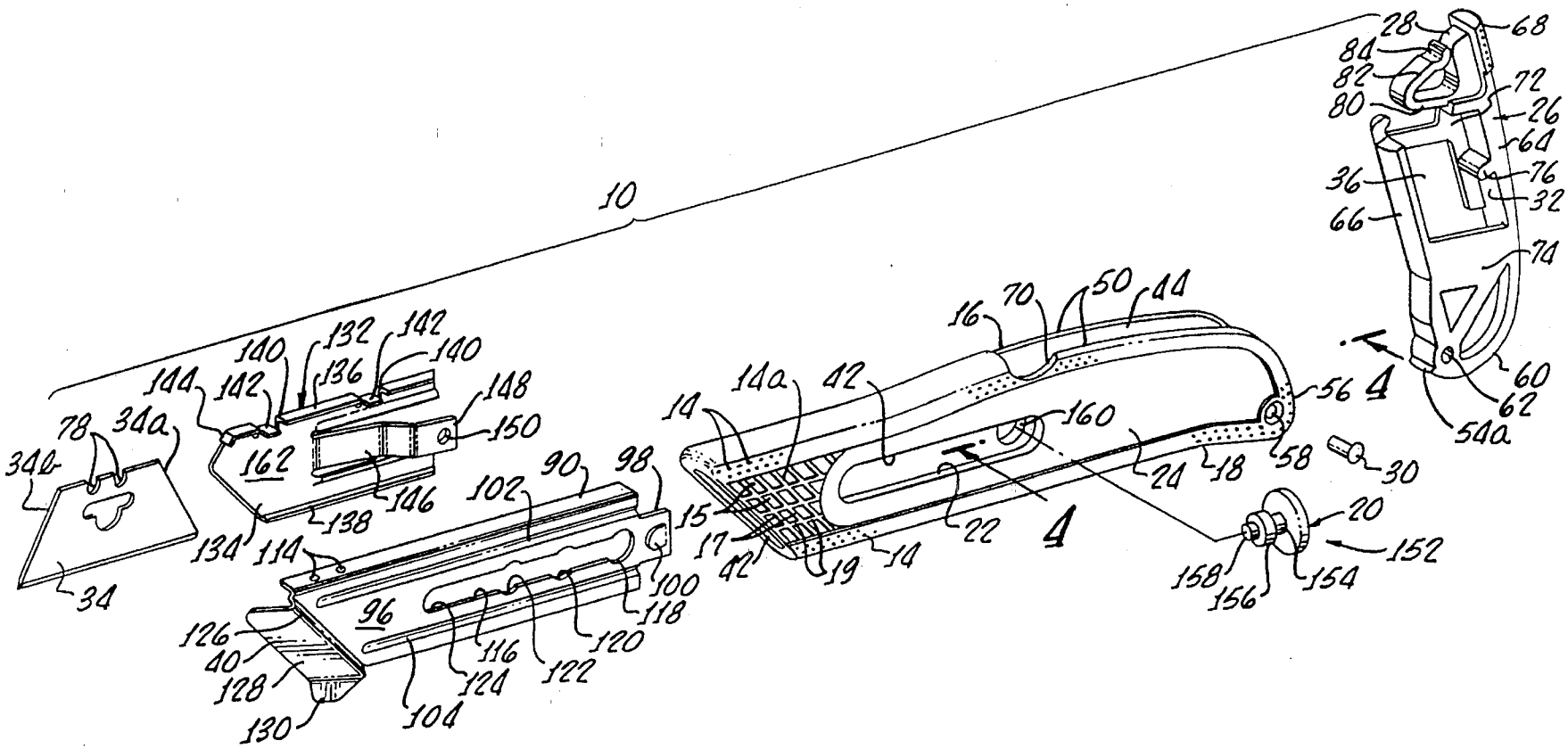

As is seen in FIG. 3, the button 20 is defined as the outer end portion of a button member referenced with numeral 152. The button member 152 includes a shaft 154 with an enlarged chamfered collar portion 156, and a rivet end section 158 extending therefrom. During manufacture of the knife 10, with the blade carrier member 132 in the channel member 90, the button member 152 is receivable inwardly through the slots 22 and 116 of the handle portion 12 and channel member 90, respectively, to dispose the enlarged collar portion 156 in the slot enlargement 118, and to extend the rivet section 158 through the aperture 150. An opening 160 (best seen viewing FIG. 3) in the handle portion 12 aligns with the slot enlargement 118, and with rivet section 158, so that a riveting tool may be laterally inserted to head section 158. Thereafter, the blade carrier member 132 is permanently captured in channel member 90. The enlarged collar portion 156 is sized for a snug laterally but not longitudinally movable fit in the enlargements 118,120, and 122. Thus, when the collar portion 156 is received in one of these slot enlargements and is retained therein by the bias applied by the integral spring arm portion 148, the blade carrier member 132 is not moveable along channel member 90. However, lateral pressure on button 20 is effective to depress the collar portion 156 out of the slot enlargements 118–122, and to allow the blade carrier member to be moved along the channel member 90 by use of button 20 with the shaft portion 154 being moveable longitudinally of slot 116.

When the button member 20 is moved to the forward end of slot 116, the blade carrier member 132 is advanced to a blade changing position partially outwardly of the channel member 90. In this position of the carrier member 132, a blade receiving recess 162 cooperatively defined by the web 134, walls 136,138, tab 144, and the collar portion 156 of button member 20 is accessible to remove a worn blade 34, and to replace this blade with a fresh one. A user of the knife 10 need only to turn the knife 10 with the side seen in FIG. 1 upwardly, and slide the button 20 fully forward in its slot. The old blade is presented to be picked out of recess 162, and will not fall therefrom. Subsequently, the user need only lay the fresh blade into the recess 162, engaging the forward one of the tangs 142 with the forward one of the notches 78 of the fresh cutting blade, and then sliding the button 20 rearwardly to one of the positions defined by enlargements 118–122.

FIG. 7 depicts the knife 10 in use as a box cutter with a cutting blade 34 extended to the carton-opening position (i.e., button member 20 at enlargement 120). This figure illustrates that the outer plate-like portion 128 of the blade guide/guard 40 is preferably angulated at an angle of about 14 degrees with respect to the length of the knife 10, and that the tip of the cutting blade is recessed a preferred distance 164 behind the forward edge of the plate-like portion 128. This preferred angulation is believed to provide the best combination of protection for carton contents, as depicted in FIG. 7, and protection for a user of the knife against accidental cuts when the blade recess distance 164 is about 3/16th inch.

While the present invention has been depicted, described, and is defined by reference to one particularly preferred embodiment of the invention, such reference does not imply a limitation on the invention, and no such limitation is to be inferred. The invention is intended to be limited only by the spirit and scope of the appended claims, which also provide a definition of the invention.

What is claimed is:

1. A utility knife comprising:

an ergonomically-shaped handle defining a longitudinal cavity at a forward end, a top surface and an aft recess substantially adjacent said top surface, a channel member received in said cavity, said channel member including a pair of opposedly arranged channel portions separated by a web portion, the web portion including first and second longitudinally extending grooves, a blade carrier member received in said channel member for receiving a cutting blade defining a cutting edge, the blade being received such that said cutting edge faces substantially away from said top surface, a lock to retain said blade carrier member in a selected position relative said handle, and a spare blade holder member pivotally received into said aft recess.

2. The utility knife of claim 1 wherein said longitudinally extending grooves slidably engage said cutting blade.

3. A utility knife comprising:

an ergonomically-shaped handle defining a longitudinal cavity at a forward end, a top surface and an aft recess substantially adjacent said top surface, a channel member received in said cavity, said channel member including a pair of opposedly arranged, generally U-shaped channel portions, a blade carrier member received in said channel member for receiving a cutting blade defining a cutting edge, the blade being received such that said cutting edge faces substantially away from said top surface, a lock to retain said blade carrier member in a selected position relative said handle, and a spare blade holder member pivotally received into said aft recess.

4. A utility knife comprising:

an ergonomically-shaped handle portion defining a longitudinal cavity at a forward end, a top surface and an aft recess substantially adjacent said top surface;

a channel member received in said cavity, the channel member including a pair of opposedly arranged, generally U-shaped channel portions;

a blade carrier member received in said channel member for receiving a cutting blade defining a cutting edge, the blade being received such that said cutting edge faces substantially away from said top surface, the blade carrier member including a pair of laterally extending wall members separated by a web, at least one wall member and an adjacent portion of said web slidably engaging one of said U-shaped channel portions;

a lock to retain said blade carrier member in a selected position relative said handle portion; and a spare blade holder member pivotally received into said aft recess.

* * * * *